United States Patent [19]

Miyazaki et al.

[11] 4,423,352

[45] Dec. 27, 1983

[54] PANEL TYPE DISPLAY APPARATUS

[75] Inventors: Toshikiyo Miyazaki, Saga; Ushio Miura, Kawasaki; Masahiro Hatanaka, Tokyo, all of Japan

[73] Assignee: Mitani Electronics Industry Corp., Fuchu, Japan

[21] Appl. No.: 279,756

[22] Filed: Jul. 2, 1981

[51] Int. Cl.[3] ..... H01J 17/49

[52] U.S. Cl. ..... 313/584

[58] Field of Search ..... 313/217, 188, 220, 582, 313/584, 585

[56] References Cited

U.S. PATENT DOCUMENTS

| | | | |
|---|---|---|---|
| 3,885,195 | 5/1975 | Amano | 313/188 X |
| 3,995,185 | 11/1976 | Miller | 313/217 |
| 4,060,749 | 11/1977 | Shinada et al. | 313/217 X |

*Primary Examiner*—Palmer C. Demeo

*Attorney, Agent, or Firm*—Oblon, Fisher, Spivak, McClelland & Maier

[57] ABSTRACT

Disclosed is a panel type display apparatus comprising a back plate and a transparent front plate, these plates facing each other at a small distance. A plurality of parallel strip-like cathodes are formed on the inner surface of the back plate facing the front plate and extend in a first direction. An insulating rib structure is formed on the inner surface of the back plate and has a lattice-like structure that extends along lines between adjacent cathodes in the aforementioned first direction and also along lines extending in a second direction at right angles to the first direction and defines a number of display element sections. A plurality of anodes are formed at least one portions of the rib structure extending in the aforementioned second direction. These anodes are formed on one side of portions of the rib structure extending in the second direction for the display element sections defined on the aforementioned one side. These anodes are isolated from the display element sections defined on the other side of the rib structure portions mentioned by partitioning rib portions raised therefrom and in contact with the front plate. Seed discharge sections are each defined in each of the display element sections in a portion of the cathode surface thereof in the vicinity of the corresponding anode.

3 Claims, 4 Drawing Figures

PANEL TYPE DISPLAY APPARATUS

BACKGROUND OF THE INVENTION

This invention relates to panel type display apparatus which make use of gas discharge for the display of such information as characters and drawings by selectively controlling the discharge of a number of display element sections.

The panel type display apparatus, which is well known as a character display of gas discharge type, has a construction in which a number of display element sections are provided at intersections of pluralities of cathodes and anodes extending perpendicular to one another. When one or more of the cathodes and anodes are selected, corresponding intersections are specified. A high voltage is applied between the cathode and anode at the specified intersections, whereby gas discharge is caused at these intersections to cause generation of dots of light therefrom. Predetermined characters or drawings are displayed as corresponding combinations of such light dots.

The panel type display apparatus of this kind has a construction comprising a transparent front plate and a back plate facing and defining a narrow space with the front plate, with a discharge gas sealed in the narrow space. A number of parallel strip-like cathodes are provided on the inner surface of the back plate. A lattice-shaped insulating rib structure is provided to divide the cathodes and define a plurality of display element sections. Anodes are provided on the inner surface of the front plate along portions thereof corresponding to the insulating rib structure such that intersections of cathode and anode are provided for the individual display element sections mentioned above.

More particularly, a number of cathodes are formed on the back plate and a number of anodes on the front plate using printing techniques. Also, the insulating rib structure which defines a number of display element sections is formed on the back plate or on the front plate or formed as divisions on both the plates. The panel type display apparatus is obtained by assembling the back and front plate such that these plates correctly face each other.

In the display apparatus of this construction, therefore, the cathodes, anodes and insulating rib structure have to be formed on the back and front plates with sufficiently high precision. Also, a display apparatus which has a predetermined display function cannot be obtained unless the back and front plates are assembled together with high precision.

With the above display apparatus, for which very high precision is required in its manufacture, therefore, it is difficult to improve the yield. Further, it is difficult to reduce the area of the individual display element sections for reducing the display elements and improve the density of display.

SUMMARY OF THE INVENTION

The object of the invention, accordingly, is to provide a panel type display apparatus, which has a sufficiently simplified construction to permit simplification particularly of manufacture and also has a reliable response characteristic.

This object has been attained by the panel type display apparatus, which comprises a transparent front plate, a back plate facing the front plate at a small distance, a plurality of parallel strip-like cathodes formed on the inner surface of the back plate facing the front plate and extending in a first direction, an insulating rib structure formed on the inner surface of the back plate and having a lattice-like structure that extends along lines between adjacent cathodes in the aforementioned first direction and also lines extending in a second direction at right angles to the first direction and defines a number of display element sections, a plurality of partitioning ribs raised from at least portions of the insulating rib structure extending in the second direction, a plurality of anodes formed along one side of the respective partitioning ribs, and seed discharge sections each formed by defining a portion of the cathode surface of each display element section in the vicinity of the corresponding anode.

With the panel type display apparatus of this construction, discharge display making full use of the entire display element and having sufficient brightness can be obtained with a sufficient response speed, and thus it is possible to effectively obtain the function of the display apparatus of this kind. Further, since the component parts of the display apparatus according to the invention are all aggregately formed only on the back plate, the apparatus can be fabricated simply precisely. Thus, the yield can be sufficiently improved, and also the production control property can be extremely improved. It is thus possible to readily fabricate a panel type character display apparatus which is of higher precision and permits an increased density of display to be obtained.

BRIEF DESCRIPTION OF THE DRAWINGS

By way of example and to make the description clearer, reference is made to the accompanying drawings, in which.

DETAILED DESCRIPTION OF THE PREFERRED EMBODIMENT

Figure 1:
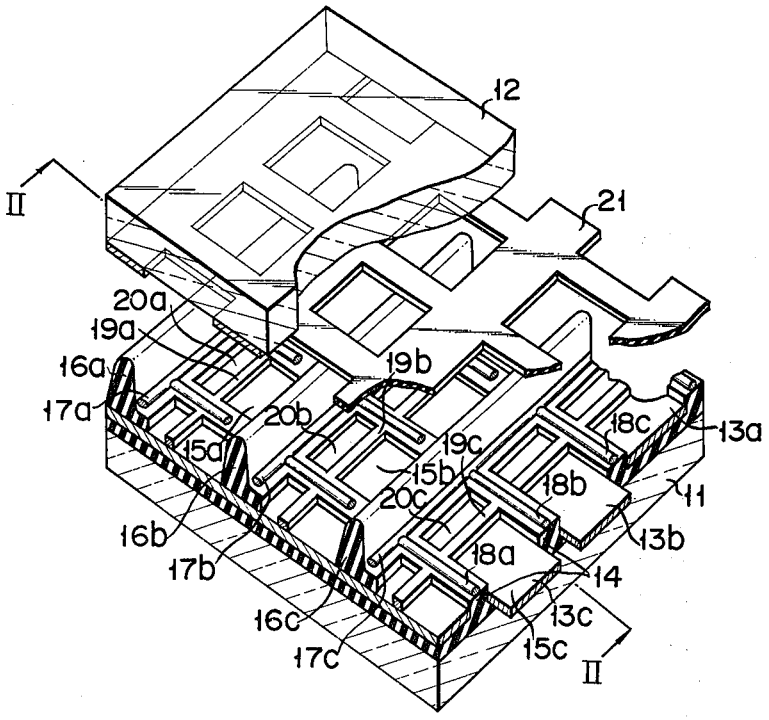
FIG. 1 is a fragmentary exploded perspective view showing an embodiment of the display apparatus according to the invention.
Figure 2:
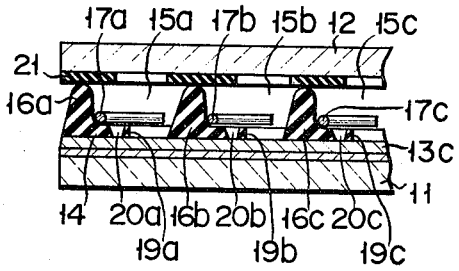
FIG. 2 is a sectional view corresponding to a section taken along line II—II in FIG. 1.

FIG. 1 shows a fragmentary exploded perspective view of an embodiment of the panel type display apparatus according to the invention, and FIG. 2 shows a sectional view corresponding to a section taken along line II—II in FIG. 1.

A back plate 11 and a front plate 12 face each other at a small distance between them. The arrangement of these plates is sealed along its edges by suitable spacers (not shown), and the sealed space is filled with a discharge gas. The front plate 12 is made of a suitable transparent glass plate.

A plurality of parallel strip-like cathodes 13*a*, 13*b*, . . . made of, for instance, nickel are formed at a narrow spacing by means of printing techniques on the inner surface of the back plate 11. An insulating rib structure 14 is formed on the inner surface of the back plate 11 and has a lattice-like structure extending along lines between adjacent cathodes 13*a*, 13*b*, . . . in the aforementioned first direction and also along lines in a second direction perpendicular to the first direction. This insulating rib structure 14 is formed by such means as repeated screen printing with respect to, for instance, the back plate 11. The cathodes 13*a*, 13*b*, . . . are divided in their longitudinal direction thereof and confined in respective rectangular sections which are defined by the lattice-like rib structure 14 as display element sections 15*a*, 15*b*, . . .

Portions of the rib structure 14 extending in the second direction perpendicular to the longitudinal direction of the cathodes 13*a*, 13*b*, . . . include raised partitioning ribs 16*a*, 16*b*, . . . which are sufficiently high in level to reach the inner surface of the front plate 12 and reliably isolate the common cathodes in the display element sections on their opposite sides. Anodes 17*a*, 17*b*, . . . of silver or the like are formed on portions of the rib structure 14 on one side of the partitioning rib portions 16*a*, 16*b*, . . . such that they cross the cathodes 13*a*, 13*b*, . . . . These anodes 16*a*, 16*b*, . . . have their action for the display element sections 15*a*, 15*b*, . . . on the side of the partitioning rib portions 16*a*, 16*b*, . . . on which they are provided. Further, auxiliary anodes 18*a*, 18*b*, . . . are formed in a comb-like form on top of portions of the rib structure 14 extending in the aforementioned first direction to define the display element sections 15*a*, 15*b*, . . . . Each of the display element sections 15*a*, 15*b*, . . . is thus surrounded by anodes formed on rib structure portions defining its three sides.

In the individual display element sections 15*a*, 15*b*, . . . , respective seed discharge sections 20*a*, 20*b*, . . . are formed. Each seed discharge section is defined in a small area of the surface of the cathode, which is in the vicinity of the corresponding one of the anodes 17*a*, 17*b*, . . . , by a corresponding one of ribs 19*a*, 19*b*, . . . , and in this section discharge is caused when a low voltage is applied between a corresponding one of the anodes 17*a*, 17*b*, . . . and a corresponding one of cathodes 13*a*, 13*b*, . . . .

The essential component parts of the panel type display apparatus, i.e., the essential component parts of the display element sections 15*a*, 15*b*, . . . are all formed on the back plate 11 by suitable means such as screen printing.

A mask 21 may be formed by printing on the front plate 12 such that it corresponds in position to the defining section that defines the individual display element sections 15*a*, 15*b*, . . . . By this mask 21 the rib structure 14 and seed sections 20*a*, 20*b*, . . . are concealed, so that the discharge display in the cathode surfaces in the individual display element sections can be recognized by sight with sufficient distinction from one another.

Figure 3A:
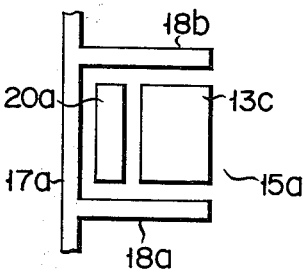
FIGS. 3A and 3B are views showing a display element section in the display apparatus shown in FIG. 1.
Figure 3B:
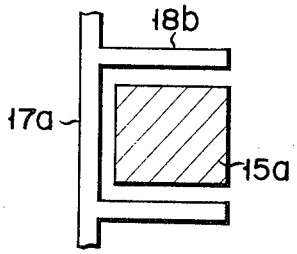

FIG. 3A shows one of the display element sections, namely section 15*a*. With a low voltage held applied between the cathode 13*c* and anode 17*a*, a seed discharge is maintained in the seed discharge section 20*a* which is defined in a small area in the sufficient vicinity of the anode 17*a*. When a sufficiently high drive voltage is applied between the cathode 13*c* and anode 17*a*, a discharge display is obtained over the entire cathode surface in the display element section 15*a* as shown in FIG. 3B. In this case, since the seed discharge is maintained in the seed discharge section, the discharge display state as shown in FIG. 3B can be obtained with sufficient response speed.

The above embodiment has been given for the purpose of illustration only and is by no means limitative, and various changes and modifications may be made without departing from the scope and spirit of the invention.

What is claimed is:

1. A panel type display apparatus comprising:

a transparent front plate;

a back plate facing said front plate at a small distance;

said front plate sealed to the back plate and containing a discharge gas therein;

a plurality of parallel strip-like cathodes formed on the inner surface of said back plate facing said front plate and extending in a first direction;

an insulating rib structure formed on the inner surface of said back plate and having a lattice-like structure extending along lines between adjacent cathodes in said first direction and also along lines extending in a second direction at right angles to said first direction;

a plurality of partitioning ribs raised from at least portions of said insulating rib structure extending in said second direction and in contact with said front plate;

a plurality of anodes formed to extend along one side of said partitioning ribs; and seed discharge sections each defined in a portion of the cathode surface in each said display element section in the vicinity of the corresponding anode.

2. The panel type display apparatus according to claim 1, wherein said anodes formed on the insulating rib structure portions extending in said second direction each include extensions extending in a comb-like form along portions of the insulating rib structure extending in said first direction on the opposite sides of the associated display element sections so that three sides of each display element section are thus surrounded by the corresponding anode.

3. The panel type display apparatus according to claim 1, wherein said front plate is formed with a lattice-like mask corresponding in position to said lattice-like insulating rib structure.

* * * * *